US009719374B2

(12) United States Patent
Maeda et al.

(10) Patent No.: US 9,719,374 B2
(45) Date of Patent: Aug. 1, 2017

(54) TURBINE HOUSING AND EXHAUST GAS TURBINE SUPERCHARGER

(75) Inventors: Osamu Maeda, Toyota (JP); Kouji Nagai, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 1290 days.

(21) Appl. No.: 13/699,063

(22) PCT Filed: Nov. 2, 2011

(86) PCT No.: PCT/JP2011/075329
§ 371 (c)(1),
(2), (4) Date: Nov. 20, 2012

(87) PCT Pub. No.: WO2013/065154
PCT Pub. Date: May 10, 2013

(65) Prior Publication Data
US 2013/0108414 A1 May 2, 2013

(51) Int. Cl.
*F01D 25/24* (2006.01)

(52) U.S. Cl.
CPC ..... *F01D 25/24* (2013.01); *F05D 2220/40* (2013.01); *F05D 2260/232* (2013.01)

(58) Field of Classification Search
CPC ... F01D 9/00; F01D 25/24; F02C 6/12; F05D 2220/40; F05D 2260/232
See application file for complete search history.

(56) References Cited

U.S. PATENT DOCUMENTS

| | | | | |
|---|---|---|---|---|
| 3,687,360 | A * | 8/1972 | Prew | B04B 11/02 138/39 |
| 4,473,931 | A * | 10/1984 | Komatsu | F01D 9/026 29/527.6 |
| 8,726,655 | B2 * | 5/2014 | Smatloch | F01D 9/026 29/889.2 |
| 2003/0077170 | A1 * | 4/2003 | Osako | F01D 5/048 415/204 |
| 2004/0109759 | A1 * | 6/2004 | Korner | F01D 9/026 415/205 |
| 2007/0089414 | A1 * | 4/2007 | Yokoyama | F01D 9/026 60/605.1 |

(Continued)

FOREIGN PATENT DOCUMENTS

| | | |
|---|---|---|
| CN | 101960120 A | 1/2011 |
| DE | 10 2008 059 936 A1 | 6/2010 |

(Continued)

OTHER PUBLICATIONS

German Office Action issued Jan. 25, 2016 in Patent Application No. 11 2011 105 790.3 (with English Translation).

(Continued)

*Primary Examiner* — Igor Kershteyn
(74) *Attorney, Agent, or Firm* — Oblon, McClelland, Maier & Neustadt, L.L.P.

(57) ABSTRACT

A turbine housing includes a first shell member and a third shell member, which are formed from metal sheets and forming a housing body, and a tongue member, which is fixed to inner circumferential surfaces of the shell members and discrete from the shell members. The tongue member defines an inlet port and a scroll compartment in the housing body.

15 Claims, 9 Drawing Sheets

(56) References Cited

U.S. PATENT DOCUMENTS

| | | | | |
|---|---|---|---|---|
| 2011/0008162 | A1 | 1/2011 | Yokoyama et al. | |
| 2012/0294709 | A1* | 11/2012 | Grussmann | F01D 25/243 415/200 |

FOREIGN PATENT DOCUMENTS

| | | | |
|---|---|---|---|
| DE | 10 2010 005 492 | A1 | 7/2011 |
| JP | 59 97237 | | 7/1984 |
| JP | 64 12007 | | 1/1989 |
| JP | 2002 349275 | | 12/2002 |
| JP | 2006 161574 | | 6/2006 |
| JP | 2007 2791 | | 1/2007 |
| JP | 2007 278130 | | 10/2007 |
| JP | 2011 127505 | | 6/2011 |

OTHER PUBLICATIONS

International Search Report Issued Jan. 24, 2012 in PCT/JP11/75329 Filed Nov. 2, 2011 (with Translation of Category).

* cited by examiner

TURBINE HOUSING AND EXHAUST GAS TURBINE SUPERCHARGER

FIELD OF THE INVENTION

The present invention relates to an exhaust gas turbine supercharger that performs supercharging when a turbine wheel is rotated by the energy of exhaust gas and to a turbine housing of the exhaust gas turbine supercharger that surrounds the turbine wheel.

BACKGROUND OF THE INVENTION

Patent document 1 describe a prior art example of an exhaust gas turbine supercharger (hereinafter, simply referred to as the supercharger) and a turbine housing.

As illustrated in FIG. 15, a turbine housing 601 described in patent document 1 includes an outer shell and an inner shell arranged between a first flange 604, which is connected to a bearing housing of a supercharger, and a second flange 605, which forms an exhaust gas outlet the supercharger. The shells form a double-tube structure.

The outer shell includes a first shell member 610, which is coupled to an outer circumferential surface of the first flange 604, and a second shell member 620, which is coupled to the second flange 605. The shell members 610 and 620 are formed by pressing metal sheets. The shell members 610 and 620 are joined with each other in a lap joint.

The inner shell includes a third shell member 630 coupled to an inner circumferential surface of the first flange 604 and a fourth shell member 640 coupled to an inner circumferential surface of the second shell member 620. The shell members 630 and 640 are also formed by pressing metal sheets. The shell members 630 and 640 are basically joined with each other in a lap joint. More specifically, an inner circumferential surface of a distal end portion 631 of the third shell member 630 and an outer circumferential surface of a basal end portion 641 of the fourth shell member 640 are joined with each other.

As illustrated in FIG. 16, the inner shell includes a tongue portion 650. The tongue portion 650 divides the inner shell into a scroll compartment 608 and an inlet port 607, which draws exhaust gas into the turbine housing 601. As described above, the shell members 630 and 640 are joined with each other in a lap joint at region R, which is indicated by an arrow in FIG. 16. The tongue portion 650 is formed by joining the shell members 630 and 640 as a flare joint.

As illustrated in FIG. 17, the third shell member 630 includes an abutment portion 632 protruding toward a distal side, and the fourth shell member 640 has an abutment portion 642 protruding toward a basal side. The abutment portions 632 and 642 abut against each other and thereby flare joined. The joined part of the abutment portions 632 and 642 form the tongue portion 650.

The turbine housing is thinner than a turbine housing that is metal cast. Thus, the heat capacity of the turbine housing is reduced. As a result, heat does not escape form the exhaust gas that passes through the turbine housing. This effectively heats a catalyst device arranged at a downstream side of the supercharger to purify the exhaust gas.

PRIOR ART DOCUMENT

Patent Document

Patent Document 1: Japanese Laid-Open Patent Publication No. 2006-161574

SUMMARY OF THE INVENTION

The turbine housing including the shell members that are flare joined to form the tongue may have the shortcomings described below.

As illustrated in FIG. 17, the tongue portion 650 has a thickness t that is two times greater than the plate thickness of the shell members 630 and 640. In this manner, the thickness of the tongue is dependent on the plate thicknesses of each shell member. Thus, when the plate thickness of each shell member is decreased to reduce the heat capacity of the turbine housing, the thickness of the tongue decreases. This makes it difficult to obtain heat resistance strength at the tongue.

When using a flared joint, twisting occurs at the boundary of the lap joined parts (631, 641) and the flare joined parts (632, 642). This forms a gap between the shell members 630 and 640. Thus to join these parts, only arc welding can be employed since arc welding can be performed even when a large gap is formed between the shell members. However, arc welding results in the occurrence of thermal distortion in the shell members.

Accordingly, it is an object of the present invention to provide a turbine housing and an exhaust gas turbine supercharger that can increase the degree of freedom for setting the heat resistance strength at portions defining an inlet port and a scroll compartment.

Means and effects for solving the above problem will now be described.

To achieve the above object, the present invention provides a turbine housing. The turbine housing surrounds a turbine wheel and includes a housing body, which is formed from a metal sheet, and a tongue member, which is fixed to an inner circumferential surface of the housing body and discrete from the housing body. The tongue member defines an inlet port and a scroll compartment in the housing body.

In this structure, the housing body is formed from a metal sheet, and the tongue member, which defines the inlet port and scroll compartment, is discrete from the housing body. Thus, the thickness and material of the tongue member can be set irrespective of the metal sheet forming the housing body. Accordingly, the degree of freedom can be increased for setting the heat resistance strength of the portion defining the inlet port and the scroll compartment.

To fix the tongue member to the housing body, brazing is preferable since this suppresses the occurrence of thermal distortion in the housing body and the tongue member.

In this case, preferably, the housing body includes two shell members sandwiching the tongue member in an axial direction of the turbine wheel, and the two shell members are joined with each other in a lap joint.

In this structure, the tongue member and the housing body are discrete bodies. Thus, the joined portions of the two shell members can entirely be joined with each other in a lap joint. As a result, welding such as arc welding, which is necessary for a flared joint, is not necessarily required, and there is no need for preparing space for a torch used in arc welding. Accordingly, the turbine housing can be reduced in size in the radial direction of the turbine wheel.

In this case, preferably, the tongue member includes a protruding portion having a shape that is in conformance with a stepped void formed by joining the two shell members in a lap joint, and the protruding portion being located in the stepped void.

In this structure, in a state in which the protruding portion of the tongue member is located in the stepped void formed by the two shell members and the tongue member is positioned, the tongue member is joined with the shell members. Thus, the positioning and joining of the tongue member to the shell members can be easily and accurately performed.

Further, preferably, the tongue member is formed by a metal piece having a predetermined thickness in an axial direction of the turbine wheel.

In this structure, the heat resistance strength of the tongue member is set in a preferable manner by setting the thickness of the tongue member in the axial direction of the turbine wheel.

Further, in a structure in which the housing body includes two shell members sandwiching the tongue member in the axial direction of the turbine wheel, and the two shell members are joined with each other in a lap joint, preferably, the tongue member is formed by a metal piece having a thickness that is greater than the sum of plate thicknesses of the two shell members in the axial direction of the turbine wheel.

In this structure, in comparison to when the two shell members forming the housing body are joined in a flare joint to define the inlet port and the scroll compartment, the thickness of the defining portion is increased. Accordingly, when the tongue member and the housing body are formed from the same material, by setting the thickness of the tongue member in such a manner, the heat resistance strength can be accurately increased at the portion defining the inlet port and the scroll compartment.

In this case, preferably, a cooling passage that circulates a cooling medium is formed in the tongue member.

In this structure, the cooling medium is circulated through the cooling passage formed in the tongue member. Thus, the temperature of the tongue member is prevented from excessively increasing. Further, the tongue member is discrete from the housing body. Thus, such a cooling passage can easily be formed. For example, water is preferred as such a cooling medium.

In this case, preferably, a bypass passage that bypasses the turbine wheel is formed in the tongue member.

In this structure, the exhaust gas drawn into the turbine housing through the inlet port can be sent toward the downstream side of the turbine wheel through the bypass passage formed in the tongue member. Thus, the tongue member can implement the function of a waste gate passage. Further, the tongue member is discrete from the housing body. This facilitates the formation of the bypass passage.

Further, preferably, the tongue member is covered by a heat insulation material.

The tongue member is exposed to the hot exhaust gas from both of the inlet port and scroll compartment and thus easily heated to a high temperature. Thus, for example, when the tongue member is joined with the housing body over a wide range with a brazing material, repetitive heating and cooling may result in a shortcoming in which thermal deterioration occurs in the tongue member due to differences in the coefficients of linear expansion of the tongue member and the brazing material.

In this regard, in the above structure, the tongue member is covered by the heat insulation material and thus directly exposed to the exhaust gas. This reduces the transfer of heat from the exhaust gas to the tongue member and suppresses temperature increases of the tongue member. This, in turn, suppresses thermal expansion of the tongue member. Accordingly, thermal deterioration of the tongue member caused by repetitive heating and cooling can be suppressed.

In this case, preferably, the tongue member includes a tip portion defining a boundary of the inlet port and the scroll compartment, and the heat insulation material covers the tip portion.

The tip portion of the tongue member, which defines the boundary of the inlet port and the scroll compartment, is tapered making it difficult to obtain the heat resistance strength. Thus, by covering the tip portion of the tongue member with the heat insulation material, temperature increases at the tip portion can be suppressed, and thermal expansion of the tip portion can be suppressed. Accordingly, thermal deterioration of the tip portion caused by repetitive heating and cooling can be suppressed.

The tip portion of the tongue member defining the boundary of the inlet port and the scroll compartment is tapered and cannot obtain heat resistance strength. Thus, repetitive thermal expansion and thermal contraction at the tip portion of the tongue member results in thermal deterioration that cannot be ignored. Such a problem seldom occurs at the proximal portion.

In this regard, in the above structure, the proximal portion of the tongue member is joined with the housing body, and the tip portion of the tongue member is free from the housing body. For example, when the tongue member is joined with the housing body with a brazing material, the brazing material is not applied to tip portion of the tongue member. This avoids the occurrence of thermal deterioration in the tongue member caused by differences in the coefficients of linear expansion of the tongue member and the brazing material.

Further, preferably, the tongue member is formed from an elongated thin plate and includes a bent portion defining a boundary of the inlet port and the scroll compartment, the bent portion is bent at an intermediate position in a longitudinal direction of the tongue member, and the tongue member is fixed to the housing body only at two ends in the longitudinal direction.

In this structure, the tongue member is flexible in a direction perpendicular to the axial direction of the turbine wheel. Thus, the tongue member is flexible even when heated to a high temperature, and the thermal energy in the tongue member can be released. This suppresses thermal deterioration of the tongue member caused by stress concentration.

In this case, preferably, a restriction member restricts displacement of the bent portion.

In a structure in which the tongue member is formed from an elongated thin plate, includes a bent portion at an intermediate position, and is fixed to the housing body only at its two ends, when the tongue member is heated to a high temperature and thermally deformed thereby displacing the bent portion, the shapes of the inlet port and the scroll compartment may change and affect the supercharging performance of the supercharger.

In this regard, the restriction member restricts displacement of the bent portion. This suppresses changes in the shapes of the inlet port and the scroll compartment in a preferred manner.

Further, in this case, when the restriction member is arranged at an inner side of the bent portion, the restriction member will not obstruct the exhaust gas flowing through the inlet port or the like.

In these cases, preferably, a seal member is arranged in an interior of the tongue member to seal a gap between the tongue member and the housing body, which surrounds the tongue member.

When the tongue member is formed from an elongated thin plate, includes a bent portion at an intermediate position, and is fixed to the housing body only at its two ends, a gap is formed between the tongue member and the housing body, which surrounds the tongue member. Thus, the exhaust gas from the inlet port may leak through the gap into the scroll compartment.

In this regard, in the above structure, the seal member seals the gap formed between the tongue member and the housing body, which surrounds the tongue member. This suppresses leakage of the exhaust gas from the inlet port through the gap into the scroll compartment.

It is preferable that the seal member be deformed in accordance with the thermal deformation of the tongue member. In other words, it is preferable that the seal member be flexible.

In this structure, the seal member is formed from a metal mesh that is flexible. Thus, the seal member deforms in a preferable manner in accordance with the thermal deformation of the tongue member. Accordingly, the flexibility of the tongue member is not affected by the arrangement of the seal member.

Further, preferably, an exhaust gas turbine supercharger includes the turbine housing of the above invention, and the turbine wheel is rotated and driven by energy of exhaust gas to perform supercharging.

DETAILED DESCRIPTION OF THE PREFERRED EMBODIMENT

An exhaust gas turbine supercharger (hereinafter, simply referred to as the supercharger) arranged on an in-vehicle internal combustion engine and a turbine housing according to a first embodiment of the present invention will now be described in detail with reference to FIGS. 1 to 7.

Figure 1:
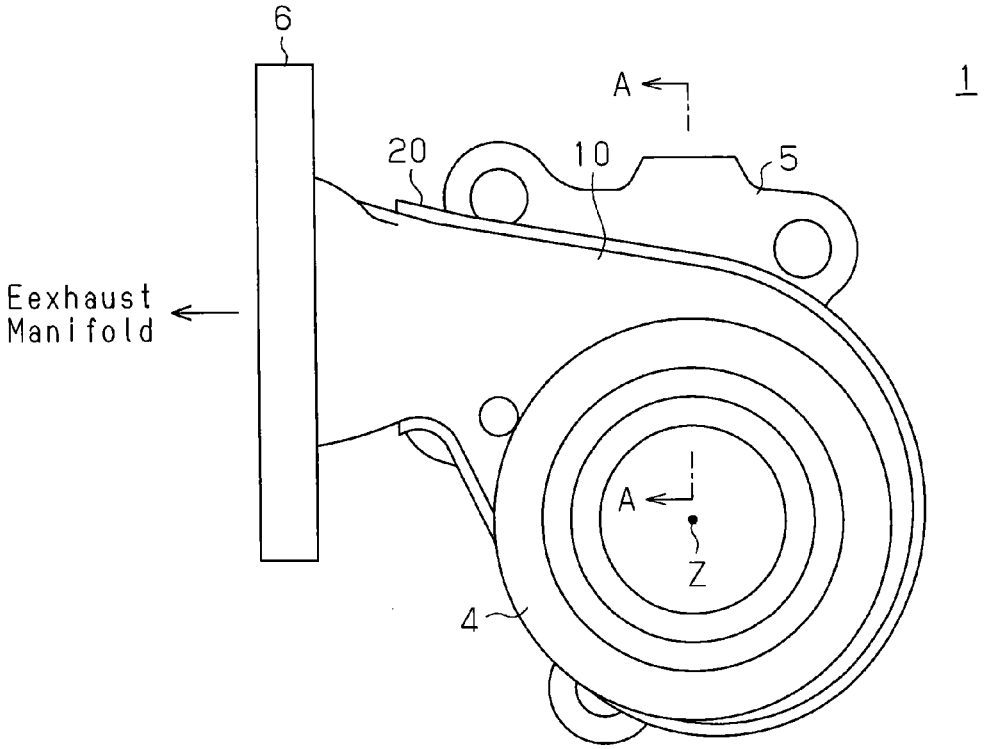
FIG. 1 is a plane view illustrating a planar structure of a turbine housing according to a first embodiment of the present invention as viewed from a bearing housing.
Figure 2:
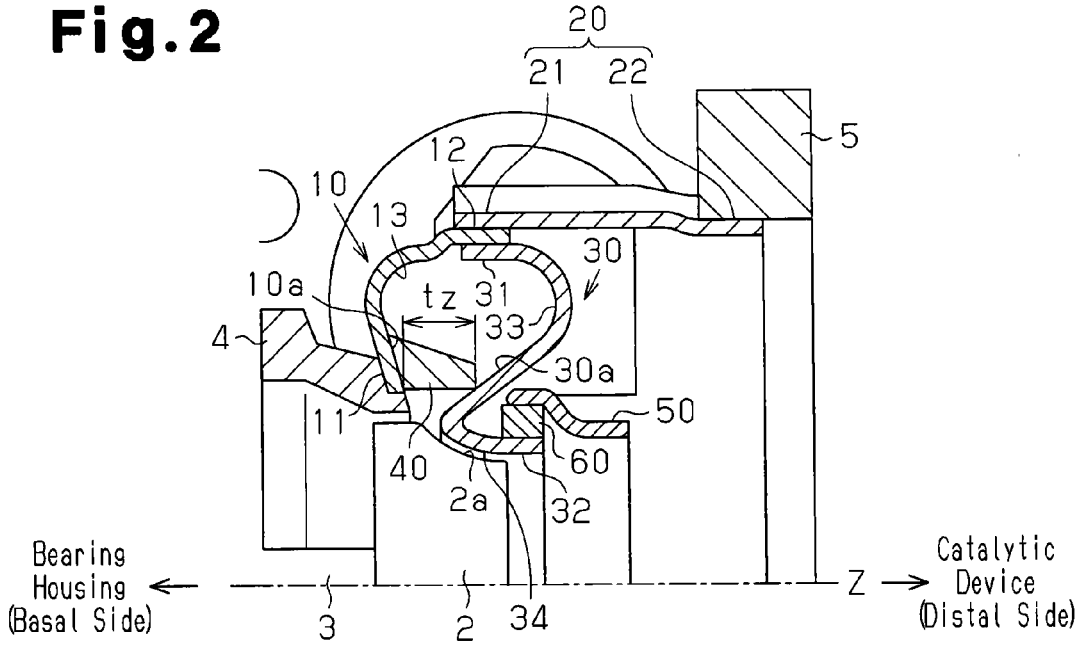
FIG. 2 is a partial cross-sectional view partly illustrating the cross-sectional structure of the turbine housing along line A-A in FIG. 1.

FIG. 1 illustrates a planar structure of the turbine housing according to the present embodiment as viewed from a bearing housing. FIG. 2 illustrates part of the cross-sectional structure of the turbine housing along line A-A in FIG. 1. The side proximal to the bearing housing in axial direction Z of a turbine wheel 2 (left side in FIG. 2) is referred to as a basal side, and the side distant from the bearing housing (right side in FIG. 2) is referred to as a distal side.

The supercharger includes the turbine wheel 2, which is arranged in an exhaust passage of the internal combustion engine and rotated and driven by the energy of exhaust gas, and a compressor impeller (not shown), which is arranged in an intake passage and coupled to the turbine wheel 2 by a turbine shaft 3. The turbine wheel 2 is arranged at a downstream side of an exhaust manifold in the exhaust passage.

As illustrated in FIGS. 1 and 2, a turbine housing 1 surrounds the turbine wheel 2. The turbine housing 1 includes three flanges 4, 5, and 6, a housing body arranged between the flanges, and a tongue member 40, which is discrete from the housing body.

The first flange 4 is connected to the bearing housing, the second flange 5 is connected to an exhaust pipe at a downstream side of the turbine housing 1, and the third flange 6 is connected to an exhaust pipe arranged at an upstream side of the turbine housing 1, namely, an exhaust manifold. The turbine shaft 3 is rotatably supported by a bearing arranged in the bearing housing. The exhaust pipe at the downstream side of the turbine housing 1 includes a catalyst device that purifies exhaust gas.

As illustrated in FIG. 2, the housing body includes three shell members 10, 20, and 30, a support pipe 50, and a seal member 60.

The three shell members 10, 20, and 30, and the support pipe 50 are formed by pressing metal sheets of stainless steel. The shell members 10, 20, and 30 each include a through hole for insertion of the turbine wheel 2. In the present embodiment, the shell members 10, 20, and 30 have the same plate thickness t1.

A basal end portion 11 of the first shell member 10 is joined with a distal end of an outer circumferential surface of the first flange 4, and an outer circumferential surface of a distal end portion 12 of the first shell member 10 is joined with an inner circumferential surface of a basal end portion 21 of the second shell member 20. An outer circumferential surface of a distal end portion 22 of the second shell member 20 is joined with an inner circumferential surface of the second flange 5. An outer circumferential surface of a basal end portion 31 of the third shell member 30 is joined with an inner circumferential surface of the distal end portion 12 of the first shell member 10. The shell members 10, 20, and 30 are joined with one another in a lap joint. More specifically, the shell members 10, 20, and 30 are joined with one another through "brazing".

An intermediate portion of the first shell member 10 from the basal end portion 11 toward the distal end portion 12 has a shape that is curved toward the basal side, and a surface at the distal side of the intermediate portion forms a concave portion 13. A portion of the third shell member 30 facing the concave portion 13 in the axial direction Z has a shape curved toward the distal side, and a surface at the basal side forms a concave portion 33. A cavity formed between the concave portions 13 and 33 defines a scroll compartment 8 of the turbine housing 1.

The third shell member 30 includes a shroud portion 34, which extends from the concave portion 33 toward the turbine wheel 2, bends, and then extends toward the distal side. The shroud portion 34 has a shape that follows a blade portion 2*a* of the turbine wheel 2.

The seal member 60 is generally cylindrical and arranged between an outer circumferential surface of a distal end portion 32 of the third shell member 30 and an inner circumferential surface of the support pipe 50. The seal member 60 is formed of, for example, a wire mesh having sealing abilities and heat resistance.

The tongue member 40 is a piece of stainless steel and sandwiched between an inner wall 10*a* of the first shell member 10 and an inner wall 30*a* of the third shell member 30 facing the inner wall 10*a* in the axial direction Z. More specifically, the tongue member 40 has a thickness tz in the axial direction Z that is larger than the sum of the plate thicknesses t1 of the first and third shell members 10 and 30 (=2×t1) (tz>2×t1).

Referring to FIGS. 2 to 7, the structure of the tongue member 40 will now be described.

Figure 3:
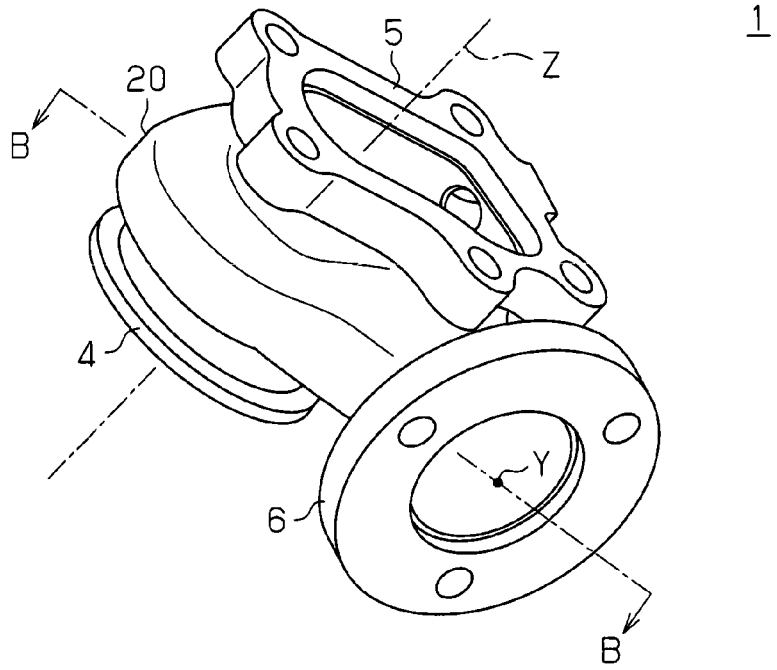
FIG. 3 is a perspective view illustrating the turbine housing of the embodiment as viewed from second and third flanges.
Figure 4:
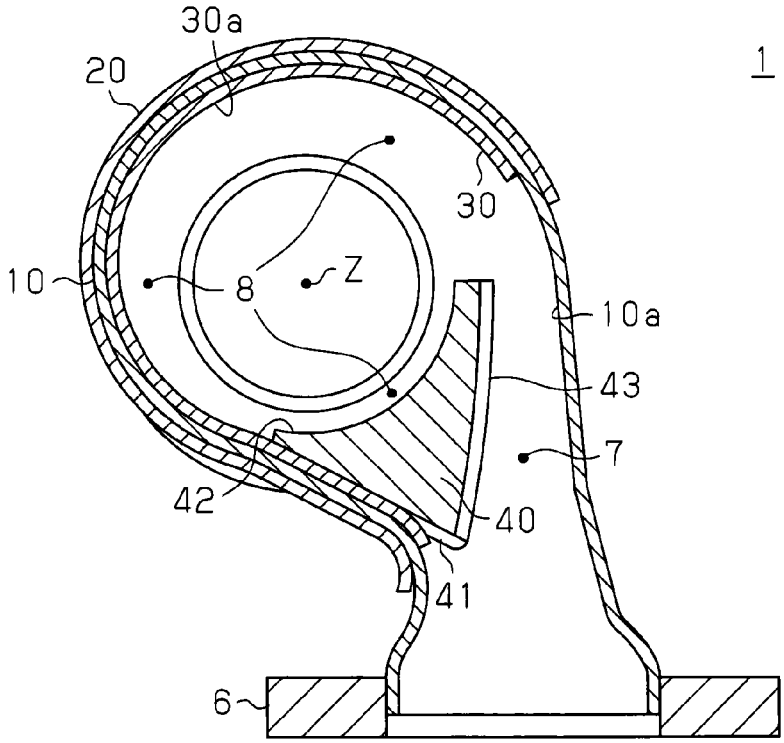
FIG. 4 is a cross-sectional view illustrating the cross-sectional structure of the turbine housing along line B-B in FIG. 5.

FIG. 3 illustrates a perspective structure of the turbine housing 1 of the present embodiment as viewed from the second flange 5 and the third flange 6. FIG. 4 illustrates the cross-sectional structure of the turbine housing 1 along line B-B in FIG. 3, that is, the cross-sectional structure extending through the center Y of a center hole in the third flange 6 and lying along a direction perpendicular to the axial direction Z of the turbine wheel 2.

As illustrated in FIG. 4, the tongue member 40 has a generally triangular cross-section. The tongue member 40 includes a bottom wall 41, a scroll wall 42, and a port wall 43 forming the sides of the triangular shape.

The scroll wall 42 has an arc shape extending about the rotation center Z of the turbine wheel 2. The scroll compartment 8 is formed by the scroll wall 42, the inner wall 10*a* of the first shell member 10 (not illustrated in FIG. 4), and the inner wall 30*a* of the third shell member 30.

The port wall 43, the inner wall 10*a* of the first shell member 10, and the inner wall 30*a* of the third shell member 30 form an inlet port 7. The inlet port 7 is a passage for drawing the exhaust gas that flows into the turbine housing 1 through the third flange 6 into the scroll compartment 8. The inlet port 7 has a cross-sectional passage area that decreases toward the downstream side (upper side as viewed in FIG. 4).

In this manner, the interior of the turbine housing 1 is divided by the tongue member 40 into the inlet port 7 and the scroll compartment 8.

Figure 5:
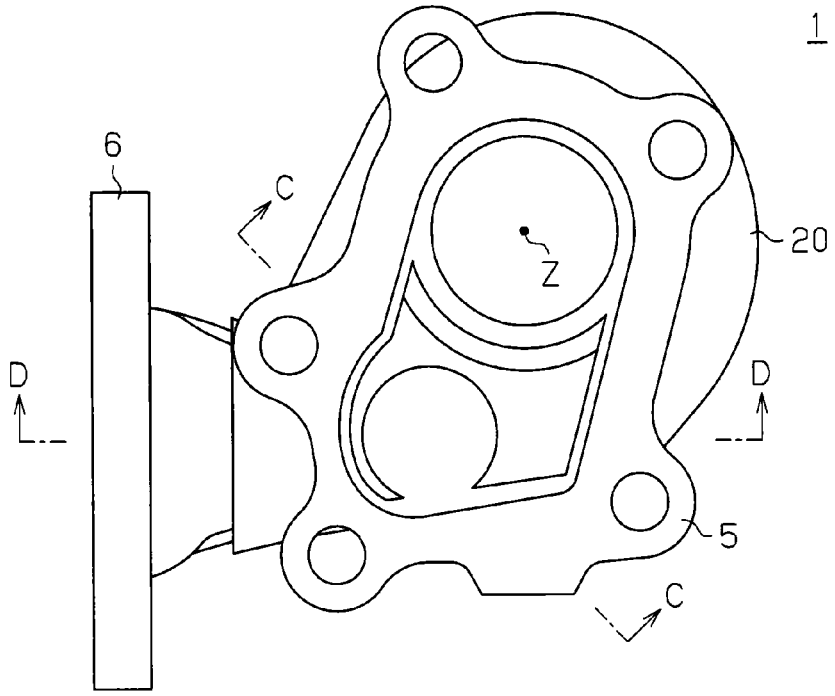
FIG. 5 is a plane view illustrating the turbine housing of the embodiment as viewed from the second-flange.
Figure 6:
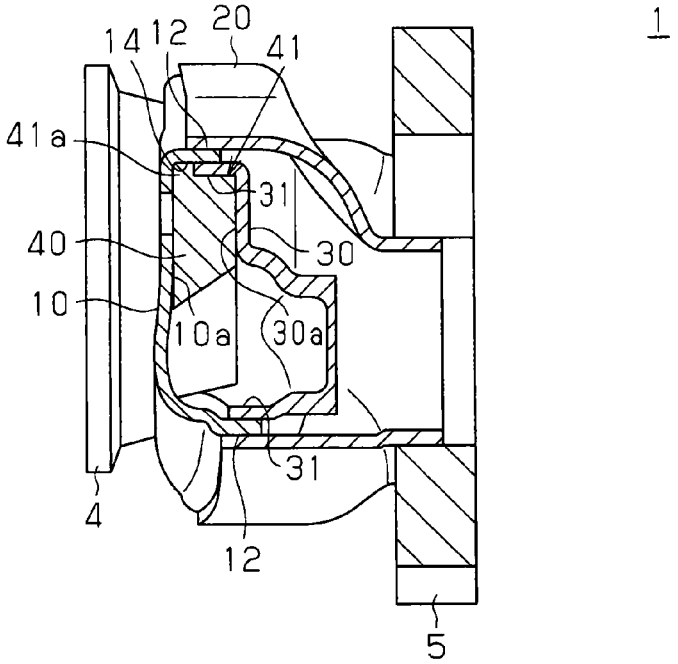
FIG. 6 is a cross-sectional view illustrating the cross-sectional structure of the turbine housing along line C-C in FIG. 5.
Figure 7:
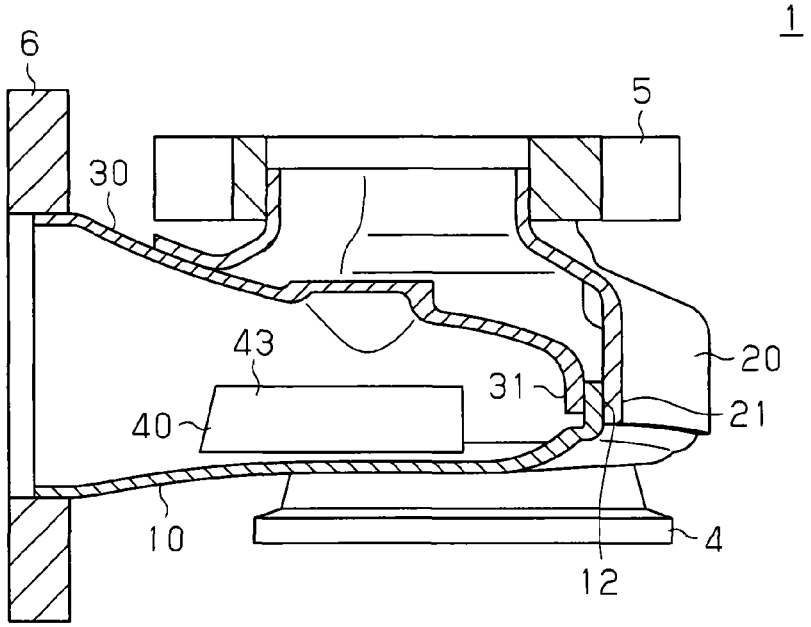
FIG. 7 is a cross-sectional view illustrating the turbine housing along line D-D in FIG. 5.

FIG. 5 illustrates a planar structure of the turbine housing 1 in the present embodiment as viewed from the second flange 5. FIG. 6 illustrates the cross-sectional structure of the turbine housing 1 along line C-C in FIG. 5. FIG. 7 illustrates the cross-sectional structure of the turbine housing 1 along line D-D in FIG. 5.

As illustrated in FIGS. 4 and 6, the bottom wall 41 of the tongue member 40 has a shape that follows an inner circumferential surface of an overlapped portion of the first shell member 10 and the third shell member 30. More specifically, the first shell member 10 and the third shell member 30 are joined in a lap joint to form a stepped void 14 in the inner circumferential surface of the distal end portion 12 of the first shell member 10 and an inner circumferential surface of the basal end portion 31. The bottom wall 41 has a protruding portion 41*a* that corresponds to the stepped void 14. The protruding portion 41*a* is located in the stepped void 14.

The operation of the present embodiment will now be described.

The first shell member 10 and the third shell member 30 forming the turbine housing 1 are formed from metal sheets, and the tongue member 40 defining the inlet port 7 and the scroll compartment 8 is discrete from the shell members 10 and 30. The tongue member 40 is a metal piece having the predetermined plate thickness tz in the axial direction Z, and the thickness tz is greater than the sum of the plate thicknesses t1 of the first and third shell members 10 and 30 (=2×t1) (tx>2×t1). Thus, the thickness tz of the defining portion is increased as compared with the prior art structure in which the shell members 630 and 640 are joined as a flare joint to form the tongue portion 650 that defines the inlet port 607 and the scroll compartment 608 as illustrated in FIGS. 15 to 18. In other words, the thickness tz of the defining portion is increased as compared with the prior art structure in which the thickness t1 of the tongue portion 650 in the axial direction Z is equal to the sum of the plate thicknesses of the two shell members 630 and 640. This increases the heat resistance strength of the tongue member 40.

The tongue member 40 is sandwiched between the two shell members 10 and 30 in the axial direction Z, and these shell members 10 and 30 are brazed and joined with each other in a lap joint. The tongue member 40 is discrete from the first shell member 10 and the third shell member 30 that form the housing body as described above. Thus, the joined portions of the two shell members 10 and 30 can entirely be joined with each other in a lap joint. As a result, welding such as arc welding, which is necessary for a flared joint, is not necessarily required, and there is no need for preparing space for a torch used in arc welding.

The turbine housing and the exhaust gas turbine supercharger of the present embodiment described above have advantages (1) to (4) as described below.

(1) The turbine housing 1 includes the first shell member 10 and the third shell member 30, which are formed from metal sheets and form the housing body, and the tongue member 40, which is fixed to the inner circumferential surfaces of the shell members 10 and 30, discrete from the shell members 10 and 30, and define the inlet port 7 and the scroll compartment 8 in the housing body. This structure increase the degree of freedom for setting the heat resistance strength of the tongue member 40 that is the portion defining the inlet port 7 and the scroll compartment 8.

(2) The tongue member 40 is sandwiched between the two shell members 10 and 30 in the axial direction Z of the turbine wheel 2. The shell members 10 and 30 are brazed and joined with each other in a lap joint. This structure can reduce the size of the turbine housing 1 in the radial direction of the turbine wheel 2. Further, the tongue member 40 is brazed and joined with the first shell member 10 and the third shell member 30, which form the housing body. Thus, it is unlikely for thermal distortion to occur in the shell members 10 and 30 and the tongue member 40.

(3) The tongue member 40 is a metal piece having the predetermined thickness tz in the axial direction Z of the turbine wheel 2. More specifically, the predetermined thickness tz of the tongue member 40 is greater than the sum of the plate thicknesses of the first and third shell members 10 and 30. In this structure, by setting the thickness tz of the tongue member 40 in such a manner, the heat resistance strength of the tongue member 40 can be increased.

(4) The tongue member 40 includes the protruding portion 41*a* that is located in the stepped void 14 and shaped in conformance with the stepped void 14, which is formed by joining the two shell members 10 and 30 in a lap joint. In this structure, when the tongue member 40 is positioned in a state in which the protruding portion 41*a* of the tongue member 40 is located in the stepped void 14, which is formed by the two shell members 10 and 30, the tongue member 40 is joined with the shell members 10 and 30. As a result, the positioning and joining of the tongue member 40 relative to the shell members 10 and 30 can be easily and accurately performed.

A second embodiment of the present invention will now be described with reference to FIG. 8.

Figure 8:
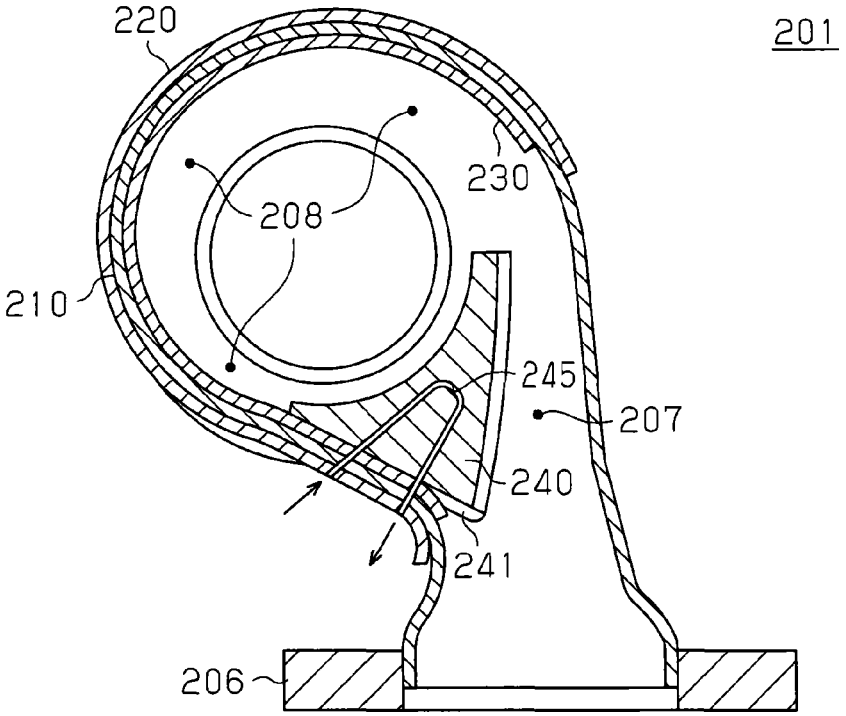
FIG. 8 is a cross-sectional view illustrating a turbine housing according to a second embodiment an corresponding to the cross-sectional structure of FIG. 4.

FIG. 8 illustrates the cross-sectional structure of a turbine housing 201 in the present embodiment and corresponds to the cross-sectional structure of FIG. 4.

Parts corresponding to those of the first embodiment will be denoted by a reference character starting with "200" and will not be described again.

In the present embodiment, a cooling passage 245, which is generally V-shaped, is formed in a tongue member 240 as illustrated in FIG. 8. The two ends of the cooling passage 245 open in a bottom wall 241. A drawing hole, which is connected to an inlet port of the cooling passage 245, and a discharge hole, which is connected to an outlet port of the cooling passage 245, extend through each of a first shell member 210, a second shell member 220, and a third shell member 230. Further, a cooling water supplying device (not shown) is connected to the drawing holes and the discharge holes to supply and discharge cooling water to and from the cooling passage 245.

The operation of the present embodiment will now be described.

The cooling water supplied from the cooling water supplying device is circulated through the cooling passage 245 formed in the tongue member 240. This prevents excessive temperature increases of the tongue member 240.

The turbine housing and the exhaust gas turbine supercharger of the present embodiment described above have advantage (5), which is described below, in addition to advantages (1) to (4) of the first embodiment.

(5) The cooling passage 245 formed in the tongue member 240 circulates cooling water. This structure prevents the temperature of the tongue member 240 from being excessively increased. Further, the tongue member 240 is discrete from the shell members 210 and 230. Thus, the cooling passage 245 can be easily formed in the tongue member 240.

A turbine housing and an exhaust gas turbine supercharger according to a third embodiment of the present invention will be described with reference to FIGS. 9 and 10.

Figure 9:
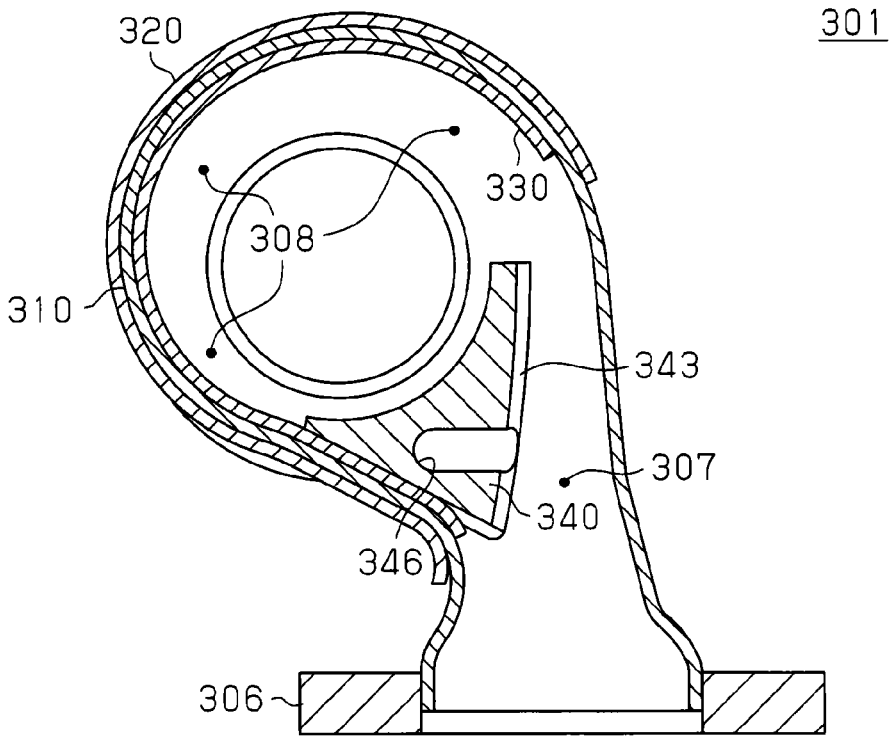
FIG. 9 is a cross-sectional view illustrating a turbine housing according to a third embodiment and corresponding to the cross-sectional structure of FIG. 4.
Figure 10:
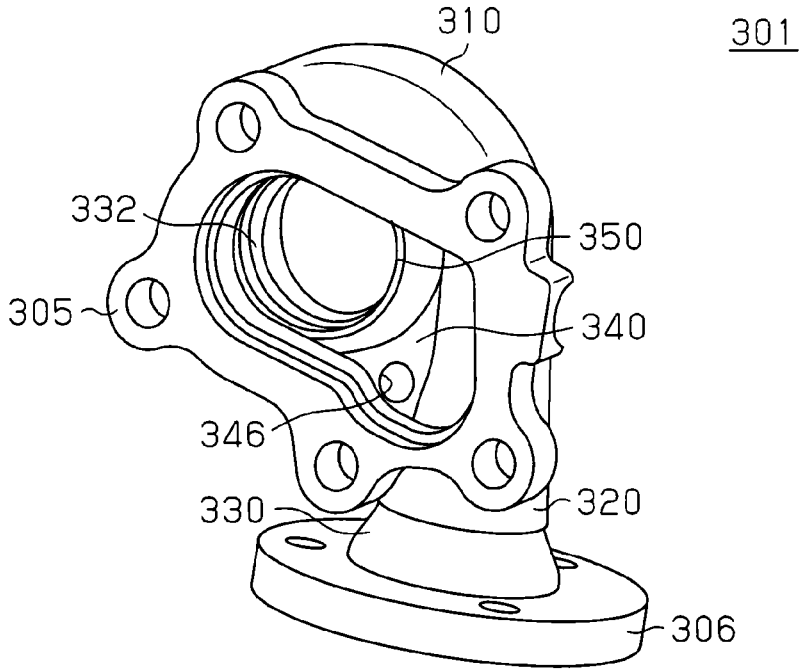
FIG. 10 is a perspective view illustrating the turbine housing according to the embodiment as viewed from a second flange.

FIG. 9 illustrates the cross-sectional structure of a turbine housing 301 of the present embodiment and corresponds to the cross-sectional structure of FIG. 4. FIG. 10 illustrates a perspective structure of the turbine housing 301 of the present embodiment as viewed from a second flange 305. Parts corresponding to those of the first embodiment will be denoted by a reference character starting with "300" and will not be described again As illustrated in FIG. 9, a bypass passage 346 is formed in a tongue member 340. The bypass passage 346 has one end that opens in a port wall 343 and another end that opens in a surface of the tongue member 340 at a distal side (upward from plane of FIG. 10) as illustrated in FIG. 10. The bypass passage 346 is a passage connecting an inlet port 307 to a downstream side of the turbine wheel 2, that is, a passage bypassing the turbine wheel 2. Though not illustrated in the drawings, an outlet of the bypass passage 346 includes a valve driven by an actuator to open and close the outlet.

The turbine housing and the exhaust gas turbine supercharger of the present embodiment described above have advantage (6), which is described below, in addition to the advantages (1) to (4) of the first embodiment.

(6) The bypass passage 346 is formed in the tongue member 340 to bypass the turbine wheel 2. This structure allows the exhaust gas drawn into the turbine housing 1 through the inlet port 307 to be sent through the bypass passage 346 formed in the tongue member 340 to the downstream side of the turbine wheel 2. In this manner, the tongue member 340 implements the function of a waste gate passage. Further, the tongue member 340 is discrete from the shell members 310 and 330. This facilitates the formation of the bypass passage 346.

A fourth embodiment of the present invention will now be described with reference to FIGS. 11 and 12.

Figure 11:
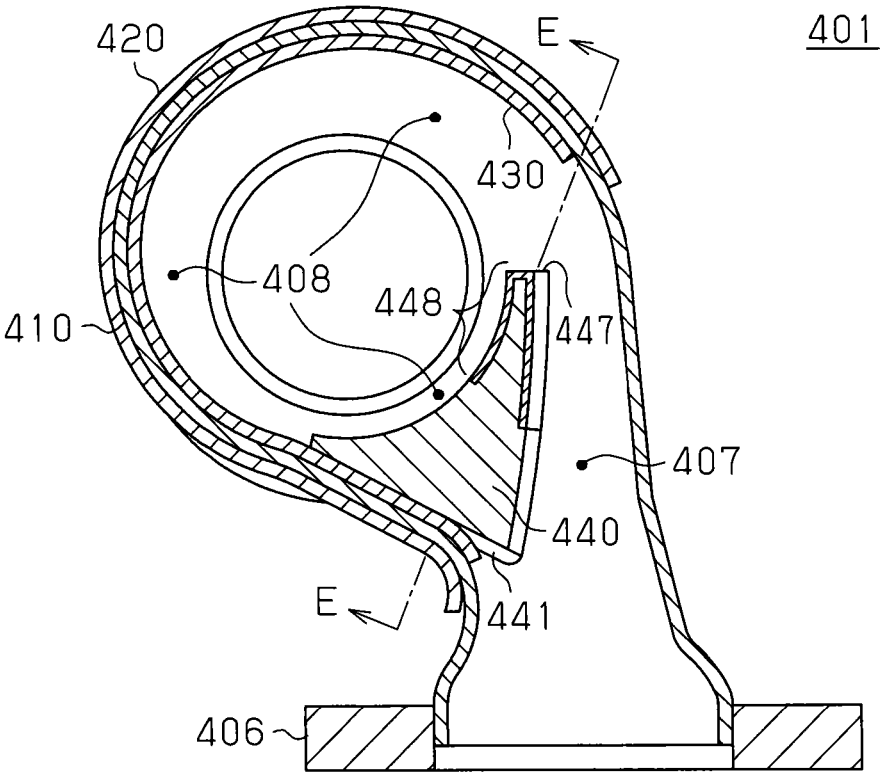
FIG. 11 is a cross-sectional view illustrating a turbine housing according to a fourth embodiment and corresponding to the cross-sectional structure of FIG. 4.

FIG. 11 illustrates the cross-sectional structure of a turbine housing 401 of the present embodiment and corresponds to the cross-sectional structure of FIG. 4. FIG. 12 illustrates the cross-sectional structure of the turbine housing 401 along line E-E in FIG. 11. Parts corresponding to those of the first embodiment will be denoted by a reference character starting with "400" and will not be described again The tongue member is exposed to the hot exhaust gas from both of the inlet port and the scroll compartment and thus apt to being heated to a high temperature. Thus, for example, when the tongue member and the housing body, which surrounds the tongue member, are brazed and joined over a wide range, repetitive heating and cooling may result in thermal deterioration of the tongue member due to the difference in the coefficients of linear expansion of between the tongue member and the alloy used as the brazing material. In particular, a tip portion of the tongue member defining the boundary of the inlet port and the scroll compartment has a tapered shape and thus makes it difficult to obtain heat resistance strength.

Figure 12:
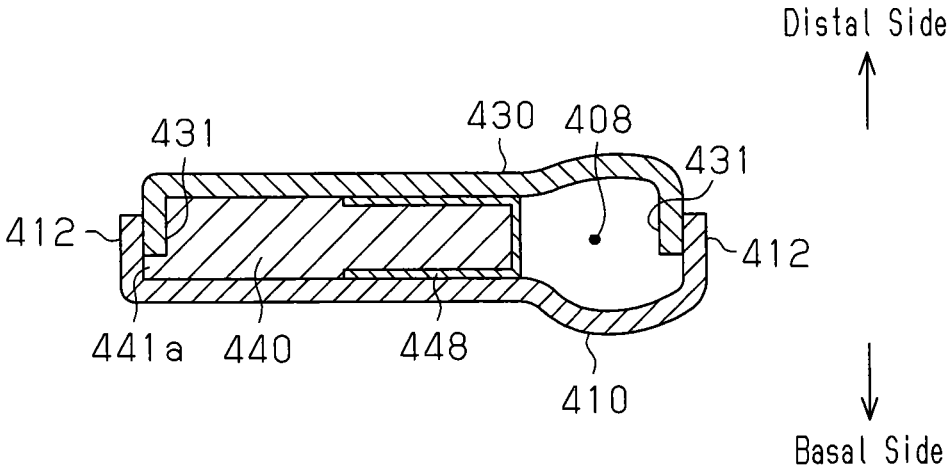
FIG. 12 is a cross-sectional view illustrating the turbine housing along line E-E in FIG. 11.

Accordingly, in the present embodiment, as illustrated in FIGS. 11 and 12, a tongue member 440 is covered by a heat insulation member 448. The tongue member 440 includes a tip portion 447 that gradually narrows toward the boundary of an inlet port 407 and a scroll compartment 408. Further, the heat insulation member 448 entirely coat a portion extending from the tip portion 447 to a substantially center position between the tip portion 447 and a bottom wall 441.

The heat insulation member 448 is made of glass fibers have superior heat insulation and heat resistance properties.

The operation of the present embodiment will now be described.

The tip portion 447 of the tongue member 440 is covered by the heat insulation member 448. Thus, the tongue member 440, particularly, the tip portion 447, is not directly exposed to the exhaust gas. This prevents the heat of the exhaust gas from being transferred to the tip portion 447 and avoids temperature increase and thermal expansion of the tip portion 447.

The turbine housing and the exhaust gas turbine supercharger of the present embodiment described above have advantage (7) in addition to advantages (1) to (4) of the first embodiment.

(7) The tongue member 440 is covered by the heat insulation member 448. More specifically, the tongue member 440 has the tip portion 447 defining the boundary of the inlet port 407 and the scroll compartment 408, and the tip portion 447 is covered by the heat insulation member 448. The covering with the heat insulation member can suppress thermal deterioration of the tip portion 447 caused by repetitive heating and cooling.

A fifth embodiment of the present invention will be hereinafter described with reference to FIGS. 13 and 14.

Figure 13:
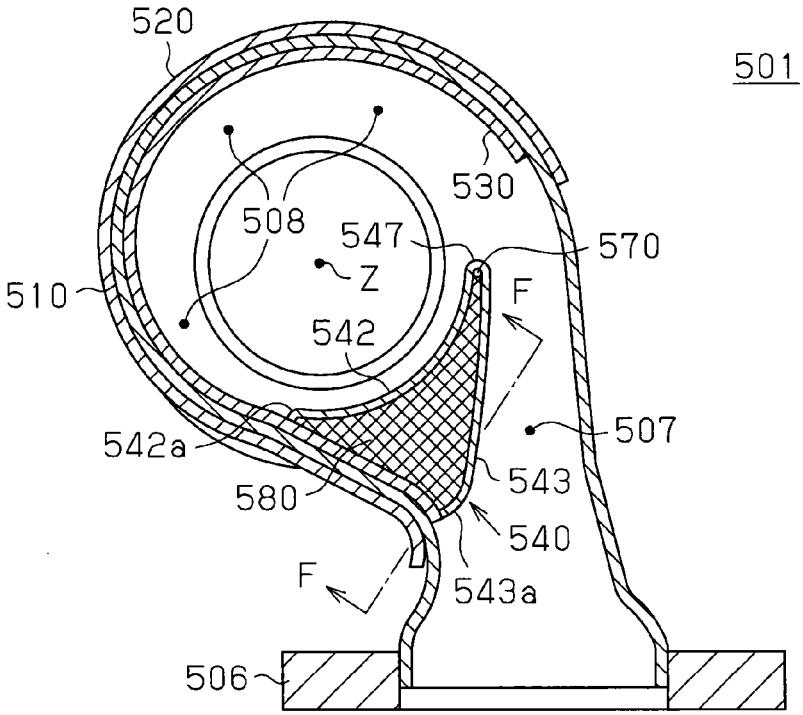
FIG. 13 is a cross-sectional view illustrating the cross-sectional structure of a turbine housing according to a fifth embodiment and corresponding to the cross-sectional structure of FIG. 4.
Figure 14A:
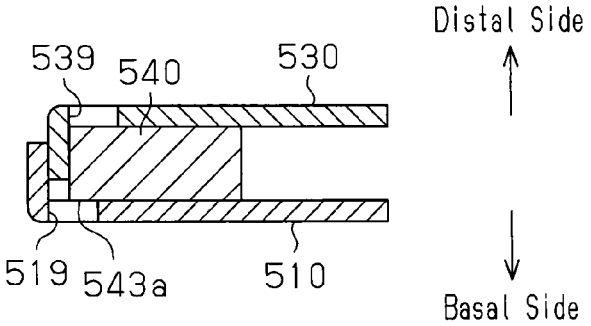
FIG. 14 shows cross-sectional views illustrating of the turbine housing along line F-F of FIG. 13, where (*a*) is a cross-sectional view before brazing, and (*b*) is cross-sectional view after brazing.
Figure 14B:
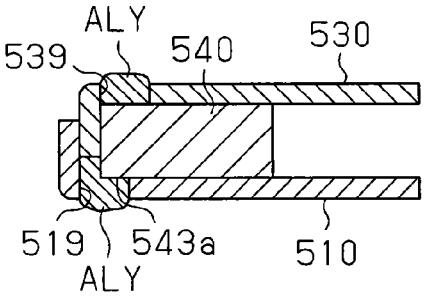
Figure 15:
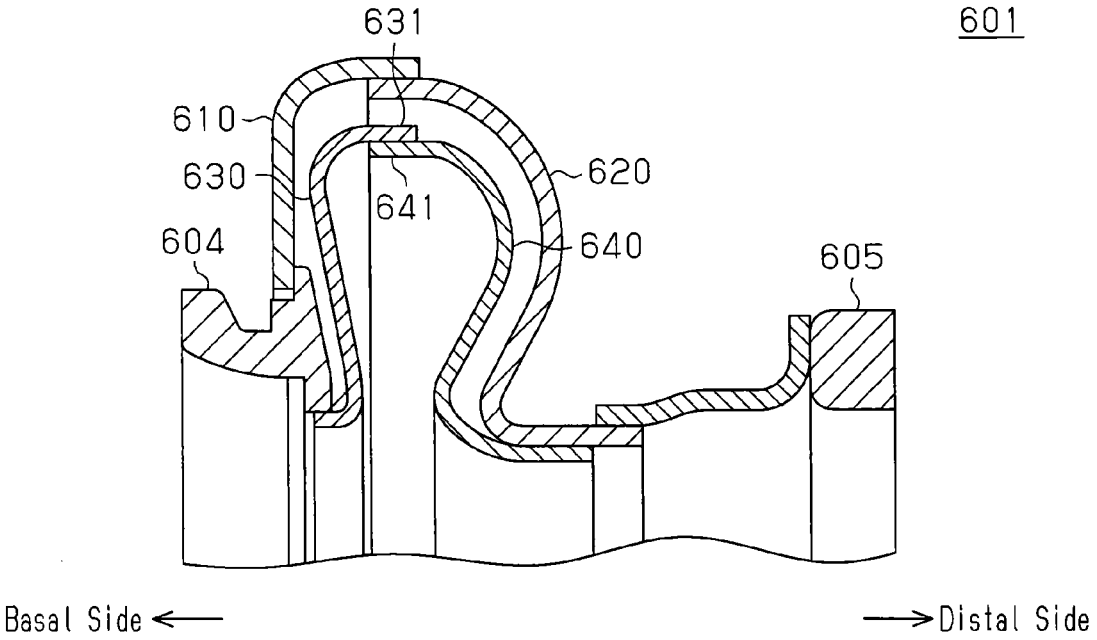
FIG. 15 is a cross-sectional view illustrating the cross-sectional structure of a prior art turbine housing taken along an axial direction of a turbine wheel.
Figure 16:
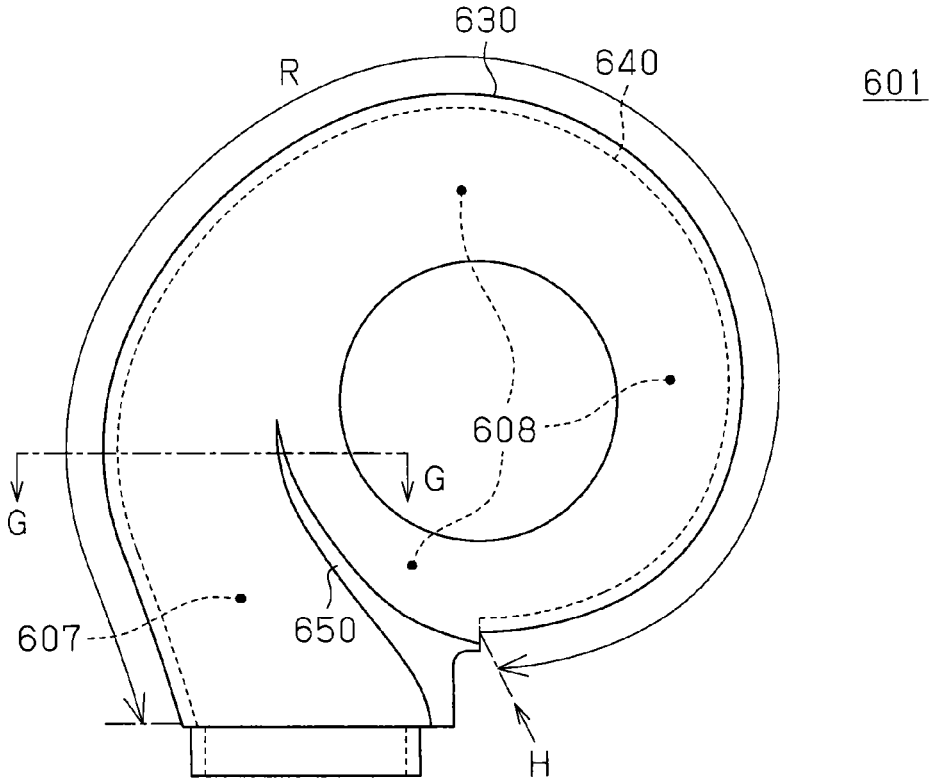
FIG. 16 is a cross-sectional view illustrating the cross-sectional structure of an inner shell in the prior art turbine housing taken along a direction perpendicular to the axial direction of the turbine wheel.
Figure 17:
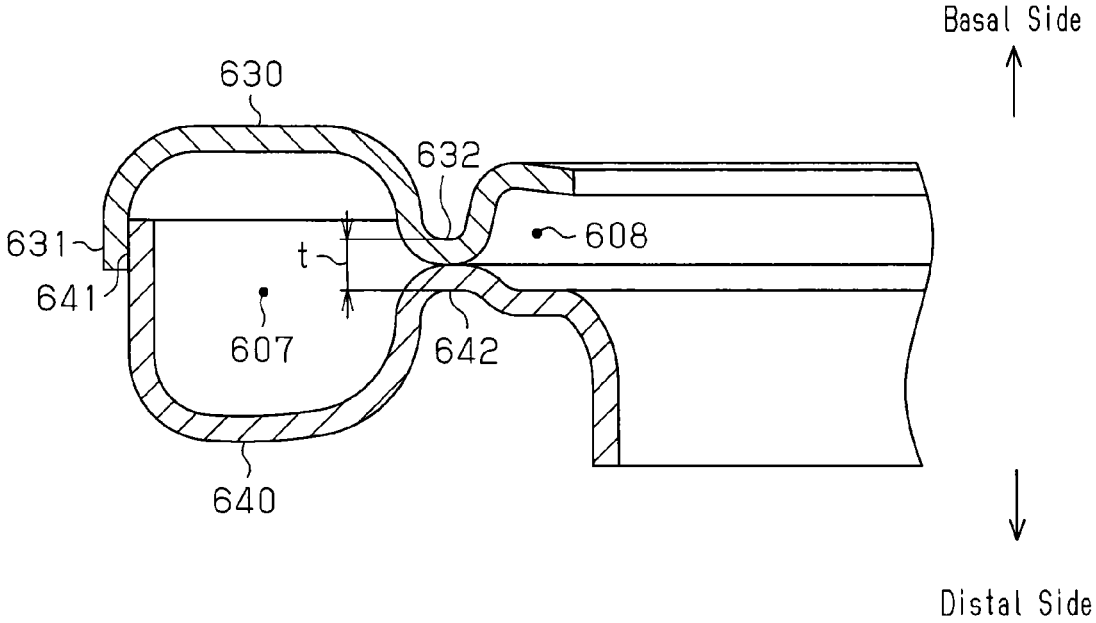
FIG. 17 is a cross-sectional view illustrating the inner shell taken along line G-G in FIG. 16.
Figure 18:
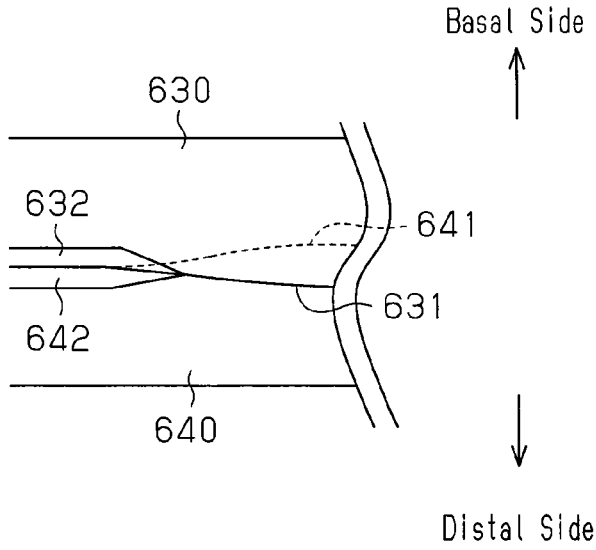
FIG. 18 is a side view illustrating the inner shell as viewed in a direction of arrow H in FIG. 16.

FIG. 13 illustrates the cross-sectional structure of a turbine housing 501 in the present embodiment and corresponds to the cross-sectional structure of FIG. 4. FIG. 14 illustrates the cross-sectional structure of the turbine housing 501 along line F-F in FIG. 13. Parts corresponding to those of the first embodiment will be denoted by a reference character starting with "500" and will not be described again As illustrated in FIG. 13, a tongue member 540 is formed to be generally V-shaped by bending an elongated thin plate at an intermediate position in a longitudinal direction of the tongue member 540. More specifically, the tongue member 540 includes a scroll wall portion 542, which defines a scroll compartment 508, a port wall portion 543, which defines an inlet port 507, and a bent portion 547, which define the boundary of the inlet port 507 and the scroll compartment 508. The tongue member 540 of the present embodiment is formed from stainless steel.

A basal end portion 542*a* of the scroll wall portion 542 and a basal end portion 543*a* of the port wall portion 543 are joined with a first shell member 510 and a third shell member 530. More specifically, as illustrated in FIG. 14 (*a*), drawing holes 519 and 539 are respectively formed in portions of the first shell member 510 and the third shell member 530 corresponding to the basal end portions 542*a* and 543*a*. Further, as illustrated in FIG. 14 (*b*), an alloy ALY used for brazing is melted and filled into the drawing holes 519 and 539 to join the shell members 510 and 530 only at the two end portions 542*a* and 543*a* in the longitudinal direction of the tongue member 540.

As illustrated in FIG. 13, a restriction pin 570 is arranged at the inner side of the bent portion 547 to restrict displacement of the bent portion 547. The restriction pin 570 is attached to the shell members 510 and 530 so that the axis of the restriction pin 570 lies along the axial direction Z, and the restriction pin 570 is abut against the tongue member 540 (bent portion 547) and not fixed thereto.

The entire interior of the tongue member 540 includes a seal member 580 that seals the gap between the tongue member 540 and the shell members 510 and 530, which surround the tongue member 540. More specifically, the seal member 580 is formed from a stainless steel mesh.

The operation of the present embodiment will be described below.

The tongue member 540 is flexible in a direction perpendicular to the axial direction Z. The tongue member 540 thus bends when heated to a high temperature. This releases thermal energy from the tongue member 540.

The tongue member 540 that is formed from an elongated thin plate, includes the bent portion 547 at an intermediate position of the tongue member 540, and fixed to the shell members 510 and 530 only at the two end portions 542*a* and 543*a* has the shortcoming described below.

When the tongue member 540 is heated to a high temperature and thermally deformed, the bent portion 547 is displaced. This may change the shapes of the inlet port 507 and the scroll compartment 508 and adversely affecting the supercharging performance of the supercharger.

In this regard, in the above embodiment, the restriction pin 570 restricts displacement of the bent portion 547 and suppresses changes in the shapes of the inlet port 507 and the scroll compartment 508.

Further, a gap is formed between the tongue member 540 and the shell members 510 and 530, which surround the tongue member 540. The exhaust gas from the inlet port 507 may leak through the gap into the scroll compartment 508.

In this regard, the above embodiment seals the gap between the tongue member 540 and the housing body, which surrounds the tongue member 540, with the seal member 580.

Further, the seal member 580 is formed from the stainless steel mesh that is flexible. Thus, the seal member 580 deforms in a preferred manner in conformance with the thermal deformation of the tongue member 540.

The turbine housing and the exhaust gas turbine supercharger of the present embodiment described above have advantages (8) to (10) in addition to advantages (1) to (3) of the first embodiment.

(8) The tongue member 540 is formed from an elongated thin stainless steel plate and includes the bent portion 547, which is bent at an intermediate position in the longitudinal direction of the tongue member 540, and defines the boundary of the inlet port 507 and the scroll compartment 508. Further, the tongue member 540 is fixed to the shell members 510 and 530, which forms the housing body, at the two end portions 542*a* and 543*a* in the longitudinal direction. This structure suppresses thermal deterioration of the tongue member 540 caused by stress concentration.

(9) The restriction pin 570 is arranged at the inner side of the bent portion 547 to restrict displacement of the bent portion 547. This structure suppresses changes in the shapes of the inlet port 507 and the scroll compartment 508 in a preferred manner. Further, the restriction pin 570 does not obstruct the exhaust gas flow through the inlet port 507 and the like.

(10) The seal member 580 is arranged in the interior of the tongue member 540 to seal a gap between the tongue member 540 and the shell members 510 and 530, which surround the tongue member 540. More specifically, the seal member 580 is formed from a stainless steel mesh. This structure effectively suppresses leakage of the exhaust gas from the inlet port 507 into the scroll compartment 508 through the gap in a preferred manner. Further, this prevents the arrangement of the seal member 580 from decreasing the flexibility of the tongue member 540.

The turbine housing and the exhaust gas turbine supercharger according to the present invention are not limited to the structures of the above embodiments and may be modified as described below.

As described in the first embodiment, preferably, the tongue member 40 includes the protruding portion 41*a* so that the tongue member 40 can be easily and accurately positioned and joined to the shell members 10 and 30. However, the protruding portion may be omitted as long as the tongue member can be positioned and joined in a preferred manner without the protruding portion.

The thickness tz of the tongue member 40 in the axial direction Z is two times greater than the plate thickness of the shell members 10 and 30 in the first embodiment. However, the thickness of the tongue member may be less than or equal to two times the plate thickness of the shell members 10, 30. In the present invention, the tongue member may be formed from a material having higher heat resistance strength than the stainless steel forming the shell members. Thus, the thickness of the tongue member in the axial direction of axis may be set in accordance with the heat resistance strength of the used material.

In the first embodiment, the tongue member 40 is a mass of stainless steel and not a piece of stainless steel, that is, not hollows. Instead, the tongue member may be hollow. In this case, the weight of the tongue member can be reduced. This allows for reduction in the weight of the turbine housing and the supercharger.

In the second embodiment, the cooling water circulates through the cooling passage 245, which is formed in the tongue member 240. In this case, as long as the temperature of the tongue member can be estimated, and the flow rate of the cooling water is increased as the estimated temperature of the tongue member increases, a temperature increase of the tongue member can be accurately suppressed, and overcooling of the tongue member can be suppressed.

In the second embodiment, cooling water is circulated through the cooling passage 245. However, the cooling medium of the present invention is not limited to water. For example, a gas such as air and a liquid other than water may be circulated.

In the fourth embodiment, part of the tongue member 440 is covered by the heat insulation member 448. Instead, the entire tongue member may be covered by the heat insulation member.

In the fourth embodiment and its modifications, the tongue member is covered by the heat insulation member. However, the surface of the tongue member may be coated with a heat insulation material.

DESCRIPTION OF THE REFERENCE NUMERALS

1, 201, 301, 401, 510: turbine housing
2: turbine wheel
2*a*: blade portion
3: turbine shaft
4: first flange
5, 305: second flange
6, 206, 306, 406, 506: third flange
7, 207, 307, 407, 507: inlet port
8, 208, 308, 408, 508: scroll compartment
10, 210, 310, 410, 510: first shell member (housing body)
10*a*: inner wall
11: basal end portion
12, 412: distal end portion
13: concave portion
14: stepped void
20, 220, 320, 420, 520: second shell member
21: basal end portion
22: distal end portion
30, 230, 330, 430, 530: third shell member (housing body)
30*a*: inner wall
31, 431: basal end portion
32: distal end portion
33: concave portion
34: shroud portion
40, 240, 340, 440, 540: tongue member
41, 241, 441: bottom wall
41, 441*a*: protruding portion
42: scroll wall
43, 343: port wall
50: support pipe
60: seal member
245: cooling passage
346: bypass passage
447: tip portion
448: heat insulation member (heat insulation material)
519: drawing hole
539: drawing hole
542: scroll wall portion
542*a*: basal end portion
543: port wall portion
543*a*: basal end portion
547: bent portion
570: restriction pin (restriction member)
580: seal member
601: turbine housing
604: first flange
605: second flange
607: inlet port
608: scroll compartment
610: first shell member
620: second shell member
630: third shell member
631: distal end portion
632: abutment portion
640: fourth shell member
641: basal end portion
642: abutment portion
650: tongue portion

The invention claimed is:

1. A turbine housing that surrounds a turbine wheel, the turbine housing comprising:

a housing body formed from a metal sheet; and a tongue member fixed to an inner circumferential surface of the housing body and discrete from the housing body, wherein the tongue member defines an inlet port and a scroll compartment in the housing body.

2. The turbine housing according to claim 1, wherein the housing body includes two shell members sandwiching the tongue member in an axial direction of the turbine wheel, and the two shell members are joined with each other in a lap joint.

3. The turbine housing according to claim 2, wherein the tongue member includes a protruding portion having a shape that is in conformance with a stepped void formed by joining the two shell members in a lap joint, and the protruding portion being located in the stepped void.

4. The turbine housing according to claim 1, wherein the tongue member is formed by a metal piece having a predetermined thickness in an axial direction of the turbine wheel.

5. The turbine housing according to claim 2, wherein the tongue member is formed by a metal piece having a thickness that is greater than the sum of plate thicknesses of the two shell members in the axial direction of the turbine wheel.

6. The turbine housing according to claim 4, wherein a cooling passage that circulates a cooling medium is formed in the tongue member.

7. The turbine housing according to claim 4, wherein a bypass passage that bypasses the turbine wheel is formed in the tongue member.

8. The turbine housing according to claim 1, wherein the tongue member is covered by a heat insulation material.

9. The turbine housing according to claim 8, wherein the tongue member includes a tip portion defining a boundary of the inlet port and the scroll compartment, and the heat insulation material covers the tip portion.

10. The turbine housing according to claim 1, wherein the tongue member has a tapered shape that gradually narrows toward the boundary of the inlet port and the scroll compartment, and the tongue member includes a proximal portion joined with the housing body and a tip portion that is not joined with the housing body.

11. The turbine housing according to claim 1, wherein the tongue member is formed from an elongated thin plate and includes a bent portion defining a boundary of the inlet port and the scroll compartment, the bent portion is bent at an intermediate position in a longitudinal direction of the tongue member, and the tongue member is fixed to the housing body only at two ends in the longitudinal direction.

12. The turbine housing according to claim 11, further comprising a restriction member that restricts displacement of the bent portion.

13. The turbine housing according to claim 11, wherein a seal member is arranged in an interior of the tongue member to seal a gap between the tongue member and the housing body, which surrounds the tongue member.

14. The turbine housing according to claim 13, wherein the seal member is formed from a metal mesh.

15. An exhaust gas turbine supercharger comprising a turbine housing surrounding a turbine wheel, the turbine housing including:

a housing body formed from a metal sheet; and a tongue member fixed to an inner circumferential surface of the housing body and discrete from the housing body, wherein the tongue member defines an inlet port and a scroll compartment in the housing body, wherein the turbine wheel is rotated and driven by energy of exhaust gas to perform supercharging.

* * * * *